US010772475B2

(12) United States Patent
Stewart

(10) Patent No.: US 10,772,475 B2
(45) Date of Patent: Sep. 15, 2020

(54) WET WIPE FLUSHABLE ROLL COMBINATION AND METHOD

(71) Applicant: Douglas Stewart, Las Vegas, NV (US)

(72) Inventor: Douglas Stewart, Las Vegas, NV (US)

( * ) Notice: Subject to any disclaimer, the term of this patent is extended or adjusted under 35 U.S.C. 154(b) by 341 days.

(21) Appl. No.: 15/925,686

(22) Filed: Mar. 19, 2018

(65) Prior Publication Data

US 2019/0282040 A1 Sep. 19, 2019

(51) Int. Cl.
*A47K 10/38* (2006.01)
*A47K 10/22* (2006.01)
*A47K 10/32* (2006.01)

(52) U.S. Cl.
CPC ..... *A47K 10/38* (2013.01); *A47K 10/22* (2013.01); *A47K 2010/3266* (2013.01)

(58) Field of Classification Search
CPC . A47K 10/38; A47K 10/22; A47K 2010/3266
See application file for complete search history.

(56) References Cited

U.S. PATENT DOCUMENTS 4,860,893 A * 8/1989 Kaufman ..... B65D 33/24 206/390
4,957,246 A * 9/1990 Kantor ..... A47K 10/32 150/154
5,105,944 A * 4/1992 Ingalls ..... B65D 85/672 206/397
5,535,962 A * 7/1996 Bargowski ..... A47K 10/38 242/594.3
6,070,821 A * 6/2000 Mitchell ..... A47K 10/16 242/160.4
6,257,410 B1 * 7/2001 Ulmann ..... B65H 18/28 206/389
6,536,707 B2 * 3/2003 Adelakun ..... A47K 10/38 242/160.1
D838,807 S * 1/2019 Bauermann ..... D23/206
10,334,995 B1 * 7/2019 Butler ..... A47K 10/3827
2009/0072064 A1 * 3/2009 Gabor ..... A47K 10/38 242/160.3
2010/0327100 A1 * 12/2010 Fischer ..... B65H 18/28 242/523.1
2013/0032652 A1 * 2/2013 Alalu ..... A47K 10/16 242/160.4
2014/0312048 A1 * 10/2014 Cojocaru ..... A47K 10/38 221/45

* cited by examiner

*Primary Examiner* — William A. Rivera
(74) *Attorney, Agent, or Firm* — Pharar Patents & Intellectual Property; Andrew A. Pharar

(57) ABSTRACT

The wet wipe flushable roll combination disclosed herein may comprise, at least, a plurality of wet wipes, an inner roll liner, an outer packaging, and a dispensing mechanism. The combination is formed by first rolling the inner roll liner and the plurality of wet wipes, and then enclosing the resulting wet wipe roll within the outer packaging such that the plurality of wet wipes may be pulled through the dispensing mechanism. The combination is preferably formed from flexible, moisture-resistant materials so as to prevent decomposition or contamination of the system and facilitate long-term storage. A preferred system for manufacturing the present combination may involve the use of proprietary robotic arms for the manipulation and assembly of each component.

4 Claims, 5 Drawing Sheets

WET WIPE FLUSHABLE ROLL COMBINATION AND METHOD

PRIORITY NOTICE

The present application makes no claims of priority under 35 U.S.C. § 119(e) to any U.S. Provisional Patent Applications.

CROSS REFERENCE TO RELATED PATENT APPLICATIONS

The present application makes no reference to any other related filed patent applications.

STATEMENT REGARDING FEDERAL SPONSORSHIP

No part of this invention was a result of any federally sponsored research.

TECHNICAL FIELD OF THE INVENTION

The present invention relates in general to wet wipe rolls, and, more specifically, to a wet wipe flushable roll combination comprising, at least, a plurality of wet wipes, an inner roll liner, an outer packaging, and a dispensing mechanism.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Toilet paper is a tissue product used by an individual to clean the perineal and rectal areas after the discharge of bodily wastes. Such a product is generally sold as a long strip of perforated paper wrapped around a paperboard core for installation on a standard toilet paper holder. The paper itself may be made available in a plurality of plies, layers of thickness, ranging from a single ply up to six plies. The increasing thickness of such paper correlates with improved strength and absorbency characteristics. Traditionally, the paperboard core at the center of such a roll acts both as a structural support for the roll itself and as a means for spinning the roll around a standard toilet paper holder to facilitate release of the toilet paper.

It is known to have toilet paper rolls that may vary in such characteristics as size, weight, roughness, softness, or absorption, among other things. Such rolls may be made available in various colors, designs, or patterns, and may further comprise aloe, lotion, or wax to reduce their roughness. Such rolls may be injected with anti-bacterial chemicals for additional cleaning ability, or may be treated with perfumes that may mask the scent of waste products. Toilet paper rolls may also comprise variations in paper fiber length, where shorter fibers contribute to more rapid paper decomposition while longer fibers add sturdiness to the paper.

Wet wipes are a paper product that has been pre-moistened and stored in a moisture-retaining container for individual use. They may be produced to be thicker than toilet paper and may comprise longer paper fibers for additional strength characteristics. Such wipes may be infused with preservatives to prevent bacterial or fungal growth within the packaging, and may also contain softeners to reduce paper roughness.

It is known to have a wet wipe comprising cleansing fluids or alcohol-based ingredients, which may be made available in a multi-pack or individually-sealed. Such wet wipes may comprise a disposable paper or fiber, and may be suitable for one-time use in the cleaning of a soiled user. Such wet wipes may be napkin-sized, and may further comprise fragrances or scented oils that may mask the scent of waste products. Wet wipes made available in a multi-pack may comprise hard or soft packaging that contains a plurality of wipes either in a long perforated sheet or folded individually and stored together, while wet wipes available individually may be folded and sealed in single-use disposable packets.

There is a need in the art for a wet wipe flushable roll combination comprising, at least, a plurality of wet wipes, an inner roll liner, an outer packaging, and a dispensing mechanism. Such a device may facilitate the dispensing of wet wipes by employing a mechanism similar to the traditional toilet paper roll. Such a device may further reduce the incidence of failing to clean a soiled user as the wet wipes may be installed on a standard toilet paper holder and may remain within the proximity of and readily accessible to a person using the toilet.

It is to these ends that the present invention has been developed.

BRIEF SUMMARY OF THE INVENTION

To minimize the limitations in the prior art, and to minimize other limitations that will be apparent upon reading and understanding the present specification, the present invention describes a wet wipe flushable roll combination comprising, at least, a plurality of wet wipes, an inner roll liner, an outer packaging, and a dispensing mechanism.

It is an objective of the present invention to provide a wet wipe flushable roll combination that may comprise a plurality of wet wipes.

It is another objective of the present invention to provide a wet wipe flushable roll combination that may comprise a single length of perforated wet wipes.

It is an objective of the present invention to provide a wet wipe flushable roll combination that may comprise an inner roll liner.

It is another objective of the present invention to provide a wet wipe flushable roll combination that may comprise an outer packaging.

It is another objective of the present invention to provide a wet wipe flushable roll combination that may comprise a dispensing mechanism.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The present invention relates generally to wet wipe rolls, and, more specifically, to a wet wipe flushable roll combination comprising, at least, a plurality of wet wipes, an inner roll liner, an outer packaging, and a dispensing mechanism.

In a first embodiment of the present invention, the wet wipe flushable roll combination may comprise a plurality of individual wet wipes or may comprise a single length of perforated wet wipes. A plurality of individual wet wipes may be preferred where ease of separation of the individual wet wipes is sought, while a single length of perforated wet wipes may be preferred where the tearing of a single wet wipe facilitates access to the next wet wipe because they are pulled through the dispensing mechanism sequentially. The inner roll liner of the wet wipe flushable roll combination may comprise a moisture-resistant and resilient material so as to prevent its decomposition when stored against the wet wipes and to provide structural support to the roll of wet wipes. The outer packaging material may also comprise a moisture-resistant and resilient material so as to facilitate long-term storage of the wet wipe flushable roll combination and may comprise chemicals appropriate to prevent bacterial or fungal growth on the wet wipe roll.

Figure 1:
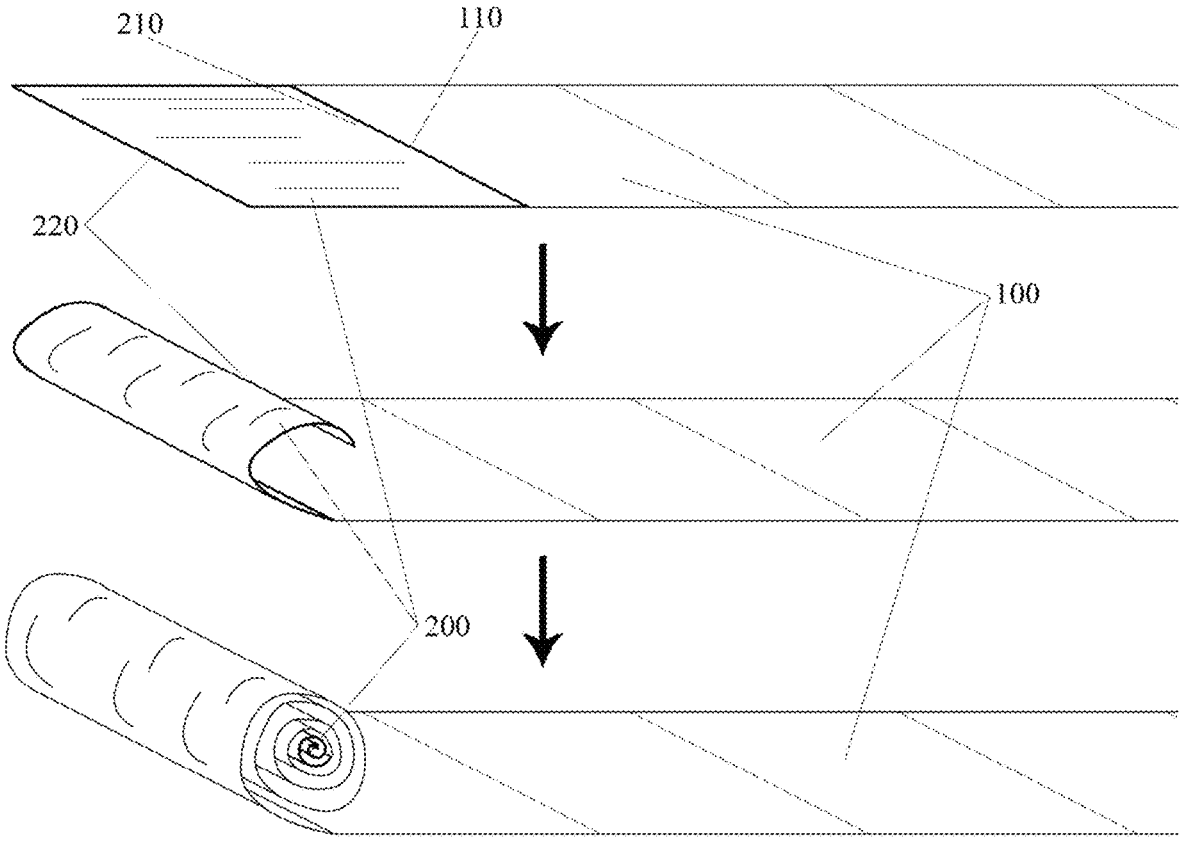
FIG. 1 illustrates a sequence by which a wet wipe flushable roll combination may be manufactured.

FIG. 1 illustrates a sequence by which a wet wipe flushable roll combination may be manufactured. In a preferred embodiment the wet wipe flushable roll manufacturing process may begin by first laying down an inner roll liner 200. The inner roll liner 200 may comprise a thick paper material or a plastic material, though is preferably made from a flexible moisture-resistant material. The inner roll liner 200 may further comprise a first edge 210 and a second edge 220. A plurality of wet wipes 100, which may comprise a length of perforated wet wipes, may further comprise a proximal end 110 and a distal end 120. The proximal end 110 of the plurality of wet wipes 100 is then laid against the first edge 210 of the inner roll liner 200. The proximal end 110 and first edge 210 may be attached to one another or may be unattached. When attached, the proximal end 110 and first edge 210 may be affixed to one another by an adhesive means, or may be affixed to one another by a perforated connection. After the proximal end 110 is laid against the first edge 210, the second edge 220 is lifted and rolled into a circular form towards the first edge 210 and proximal end 110. This rolling motion may be performed against a roll form to ensure that a minimum internal diameter is maintained within the wet wipe roll, and may continue past the first edge 210 and proximal end 110 towards the distal end 120 of the plurality of wet wipes 100. The rolling motion may continue until the entire plurality of wet wipes 100 has been included in the roll.

Figure 2:
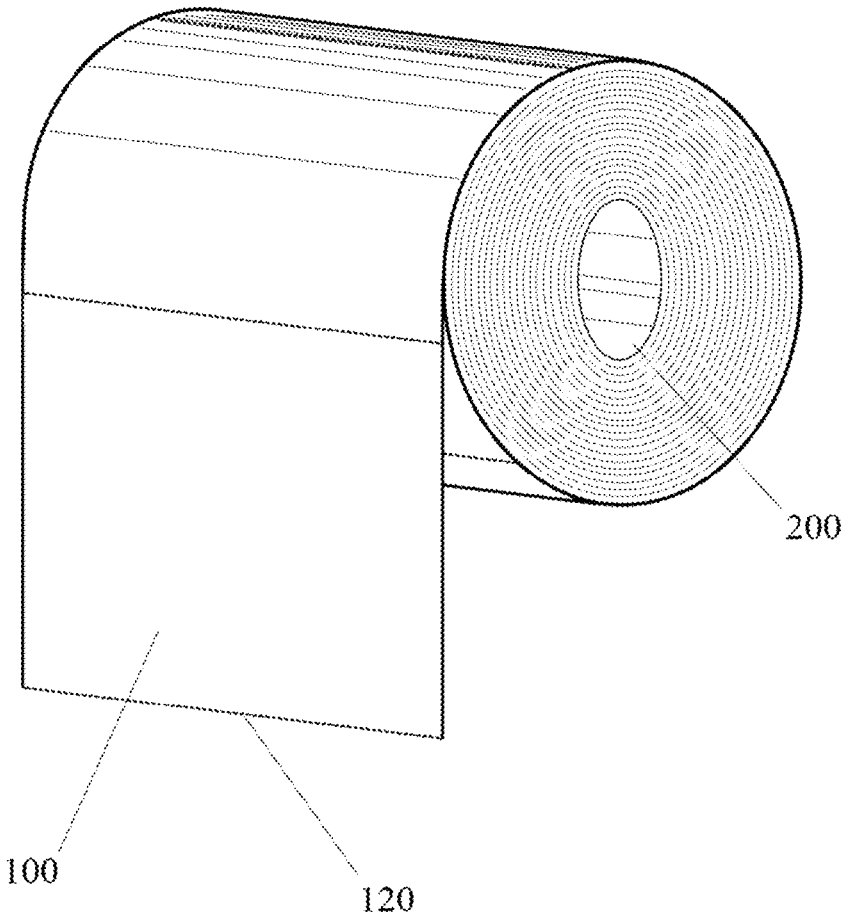
FIG. 2 illustrates a wet wipe roll as contemplated by the present invention.

FIG. 2 illustrates a wet wipe roll as contemplated by the present invention. The distal end 120 of the plurality of wet wipes 100 remains present on an outer surface of the formed wet wipe roll, and may comprise a starting point for pulling the plurality of wet wipes 100 through a dispensing mechanism 400 once the combination has been assembled. The inner roll liner 200 comprises the innermost surface of the formed wet wipe roll and has a minimum diameter sufficient to accommodate a standard toilet paper holder. Such a diameter may be preferably between one-half inch and two inches. The inner roll liner 200 does not comprise a solid inner layer, as it is preferable to the present combination that the inner roll liner 200 remain flexible.

Figure 3:
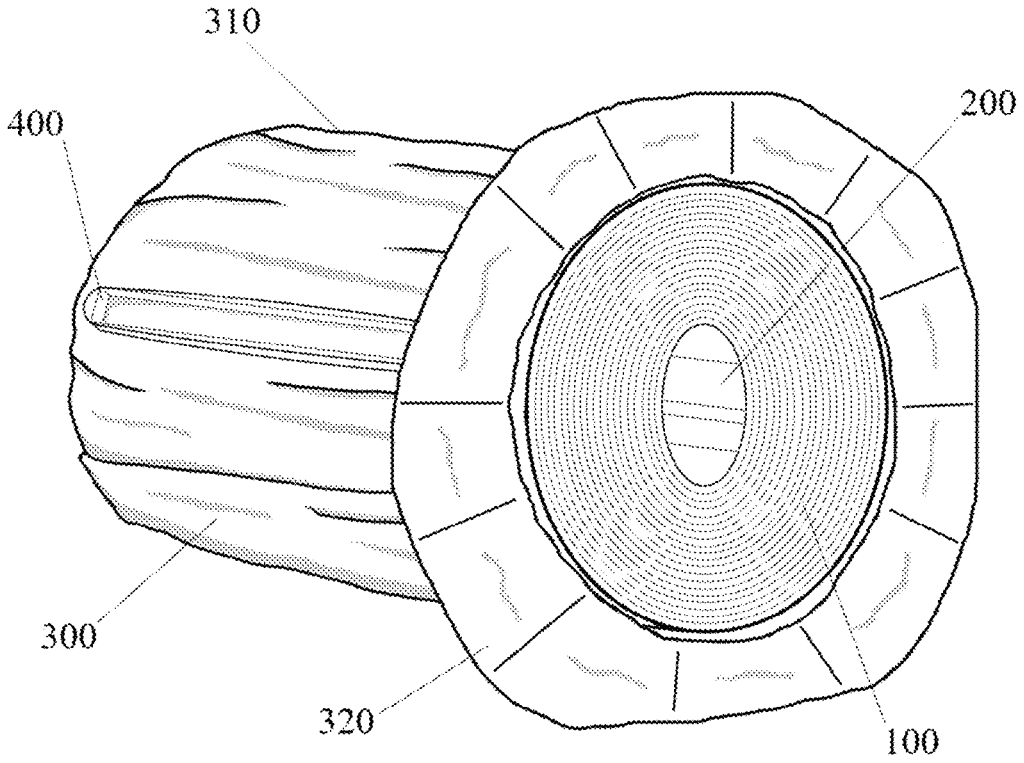
FIG. 3 illustrates a wet wipe roll installed in an outer packaging as contemplated by the present invention.

FIG. 3 illustrates a wet wipe roll installed in an outer packaging 300 as contemplated by the present invention. The outer packaging 300 may comprise a cylindrical form having an outer surface 310, a first flap 320, and a second flap 330. The wet wipe roll may be inserted into the cylindrical form with the first flap 320 and the second flap 330 overhanging the roll on either side. A dispensing mechanism 400 may be affixed to the outer surface 310 of the outer packaging 300. The dispensing mechanism 400 may comprise a rigid rectangular form that creates an opening through the outer packaging 300 and allows the distal end 120 of the plurality of wet wipes 100 to pass through it while also providing structural support to the wet wipe flushable roll combination. The dispensing mechanism 400 may further comprise a temporary seal, which may be made from a flexible and resilient material, to retain moisture within the wet wipe roll during long-term storage. Alternatively, the dispensing mechanism 400 may comprise a removably attached cover or a hinged flap to provide a means for closure. The distal end 120 of the plurality of wet wipes 100 may be oriented such that it is internal to the dispensing mechanism 400 to permit pulling of such distal end 120 through the dispensing mechanism 400. The outer packaging 300 does not comprise a solid outer layer, as it is preferable to the present combination that the outer packaging 300 remain flexible.

Figure 4:
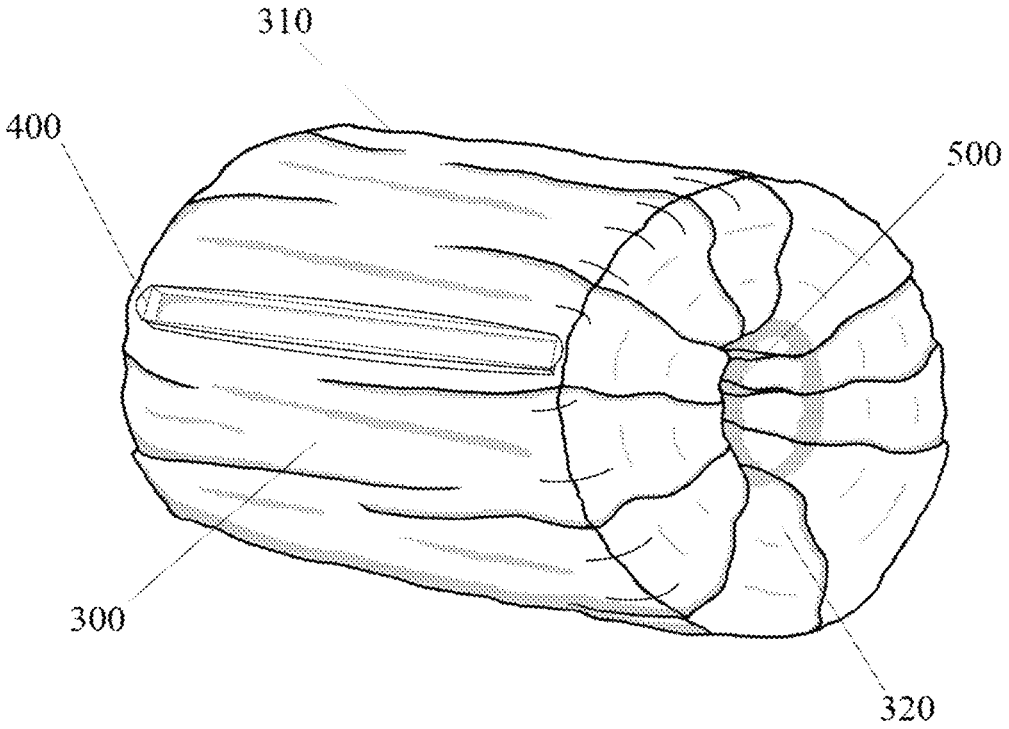
FIG. 4 illustrates a wet wipe flushable roll combination.

FIG. 4 illustrates a wet wipe flushable roll combination. To complete manufacturing of the combination the first flap 320 and second flap 330 of the outer packaging 300 may be wrapped around either end of the wet wipe roll and then tucked into the inner diameter of the inner roll liner 200. The first flap 320 and second flap 330 may then be affixed to each other within the inner diameter of the inner roll liner 200 so as to form a moisture-tight compartment, though are not attached to the inner roll liner 200 so that it may spin freely within the outer packaging 300. The tucking and affixing of the first flap 320 and second flap 330 may create a central cavity 500, through which may be placed a standard toilet paper holder.

Figure 5:
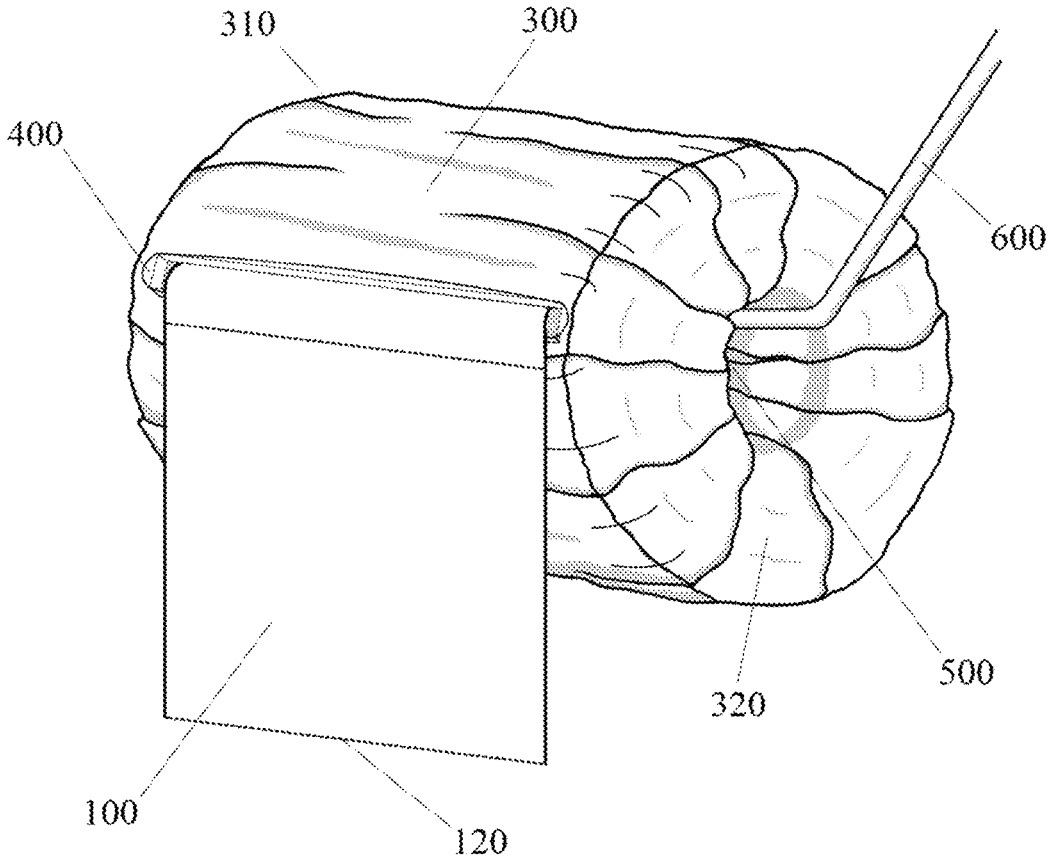
FIG. 5 illustrates a wet wipe flushable roll combination installed on a standard toilet paper holder as contemplated by the present invention.

FIG. 5 illustrates a wet wipe flushable roll combination installed on a standard toilet paper holder as contemplated by the present invention. The distal end 120 of the plurality of wet wipes 100 may be pulled through the dispensing mechanism 400, which may cause the wet wipe roll to spin within the outer packaging 300 while the outer packaging 300 itself remains stationary. The plurality of wet wipes 100 may continue to be pulled until the inner roll liner 200 is finally also pulled through the dispensing mechanism 400, leaving the outer packaging 300 empty and ready for disposal.

A preferred system for manufacturing the present combination may involve the use of proprietary robotic arms for the manipulation and assembly of each component.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A wet wipe flushable roll combination, comprising:

a plurality of wet wipes;

an inner roll liner;

an outer packaging; and a dispensing mechanism;

wherein said plurality of wet wipes have a proximal end and a distal end;

wherein said inner roll liner has a first edge and a second edge;

wherein said outer packaging has a first flap and a second flap;

wherein said outer packaging comprises a cylindrical form;

wherein said plurality of wet wipes is a single length of perforated wet wipes;

wherein said first edge of said inner roll liner is attached to said proximal end of said plurality of wet wipes;

wherein said inner roll liner and said plurality of wet wipes are rolled into a wet wipe roll starting from said second edge of said inner roll liner and rolling towards said distal end of said plurality of wet wipes;

wherein said wet wipe roll is inserted into said cylindrical form of said outer packaging; and wherein said first flap of said outer packaging and said second flap of said outer packaging are wrapped around opposing ends of said wet wipe roll and pressed internally to said inner roll liner.

2. The invention of claim 1, wherein said first flap of said outer packaging and said second flap of said outer packaging are affixed to one another internally to said inner roll liner.

3. The invention of claim 2, wherein said dispensing mechanism is affixed to an outer surface of said outer packaging.

4. A method for making wet wipe flushable roll combination, comprising:

placing an inner roll liner on a flat surface;

placing a plurality of wet wipes against said inner roll liner;

rolling said inner roll liner and said plurality of wet wipes into a wet wipe roll;

placing said wet wipe roll inside an outer packaging;

wrapping a first flap and a second flap of said outer packaging around said wet wipe roll;

pressing said first flap and said second flap internally to said inner roll liner; and affixing said first flap to said second flap internally to said inner roll liner.

* * * * *